United States Patent [19]

Kydd

[11] 4,354,852

[45] Oct. 19, 1982

[54] PHASE SEPARATION OF HYDROCARBON LIQUIDS USING LIQUID VORTEX

[75] Inventor: Paul H. Kydd, Lawrenceville, N.J.

[73] Assignee: Hydrocarbon Research, Inc., Lawrenceville, N.J.

[21] Appl. No.: 257,435

[22] Filed: Apr. 24, 1981

[51] Int. Cl.[3] ..... G01N 23/00

[52] U.S. Cl. ..... 23/230 A; 23/230.3; 55/18; 55/204; 208/DIG. 1; 208/340; 250/308; 250/364

[58] Field of Search ..... 23/230 A, 230.3; 250/308, 363, 364, 365; 208/340, DIG. 1; 55/18, 48, 52, 204

[56] References Cited

U.S. PATENT DOCUMENTS

| | | | |
|---|---|---|---|
| 2,786,801 | 3/1957 | McKinley et al. | 422/140 X |
| 2,849,930 | 9/1958 | Freeman et al. | 55/52 |
| 3,552,932 | 1/1971 | Badham | 422/140 |

FOREIGN PATENT DOCUMENTS

| | | | |
|---|---|---|---|
| 18168 | 10/1980 | European Pat. Off. | 55/204 |
| 2035150 | 6/1980 | United Kingdom | 55/204 |

*Primary Examiner*—Michael S. Marcus

*Attorney, Agent, or Firm*—Vincent A. Mallare; Fred A. Wilson

[57] ABSTRACT

For hot hydrocarbon liquids and slurries containing a vapor portion derived from a hydrogenation process, the vapor portion is separated from the liquid portion within a separation zone by providing a liquid vortex flow pattern having a gas core. The vapor is withdrawn from the vortex core through an inwardly-extending conduit, and the remaining rotating liquid portion is passed to below the vortex. If catalyst particles are also contained in the hot hydrocarbon liquid, such as in a coal or oil hydrogenation reaction effluent liquid at elevated temperature and pressure conditions, such catalysts can be conveniently separated from a product liquid stream and returned to the reaction zone along with the recycled liquid. A clean liquid stream is withdrawn from the recycled liquid for further processing. If desired, the phase separation zone utilizing a liquid vortex can be provided within the catalytic reaction zone.

8 Claims, 4 Drawing Figures

PHASE SEPARATION OF HYDROCARBON LIQUIDS USING LIQUID VORTEX

BACKGROUND OF THE INVENTION

This invention pertains to the phase separation of hydrogenated hydrocarbon liquids at elevated temperature and pressure conditions, and particularly to a phase separation flow configuration for minimizing undesired coke formation in a hot gas-liquid separation step or device.

In catalytic hydrogenation processes for heavy petroleum oil and coal feedstreams, such as for the H-Oil ® and H-Coal ® processes, a continuing problem has been deposits of carbon in the hot phase separator located immediately downstream from the catalytic reaction zone, wherein a vapor stream is separated from the reactor effluent slurry. Because of the high temperature conditions and with a deficiency of hydrogen, carbonaceous deposits usually form on the interior wall of the hot separator apparently at the interface between the vapor and liquid phases, particularly if this interface is moving as, for example, when the hot slurry is splashing on the separator inner wall.

This solids deposition problem in the hot phase separator following a hydrogenation step is difficult to avoid, because the reactor effluent slurry contains a gaseous portion, and the purpose of the phase separator is to remove the gas from the liquid. As a result, there is extensive bubbling and frothing within the separator, and it is essential to provide a considerable liquid surface from which the gas can evolve effectively. At the same time, it is desirable to minimize the solid or wall surface exposed to the froth and minimize the interface between the solid walls and the liquid by promoting a stable flow.

Numerous previous attempts to solve this coking problem in the hot separator have been made. For example, in the hydroconversion of tar sand bitumen feedstocks to produce lower-boiling liquid products, quenching the hot reactor effluent stream in the phase separator to quickly cool the oil and avoid coking has been used, as described by U.S. Pat. Nos. 3,841,981, 3,842,122 and 3,844,937. Also, in the hydrogenation of coal slurry feedstocks to produce lower-boiling product liquids and gas, a hot separator shaped to control settling velocity for liquid and contained solids has been used, as described in U.S. Pat. No. 4,151,073 to Comolli. However, troublesome deposits of coke on the hot separator vessel inner walls still sometimes occur when processing hot hydrocabon liquids, so that further improvements are desirable.

SUMMARY OF THE INVENTION

The present invention provides a phase separation flow configuration and device for handling liquids and slurries containing a minor portion of gas or vapor, particularly for hydrogenated petroleum oils and coal-derived hydrocarbon liquids. The flow configuration comprises a liquid vortex, which provides a means for eliminating the gas-liquid interface in contact with the hot separator inner wall. The phase separator comprises a generally vertical section into which liquid slurry and vapor mixture, usually at elevated temperature of at least 500° F. and pressure at least 500 psig from a catalytic reaction zone, flows into the upper end, and from which a vapor stream is withdrawn through an inwardly extended tube. Near the lower end of this tube, at least one flow passageway for producing rotation of the liquid-gas mixture is provided, such as a nozzle or angled swirl vanes, which causes the flowing vapor-liquid mixture to form a helical or vortex flow pattern within the conduit. At the core of the vortex, the vapor portion is separated from the liquid due to the centrifugal force acting on the swirling liquid.

As the liquid or slurry proceeds further along the conduit, the vortex pattern gradually diminishes in size as viscous drag forces slow down the rotational velocity of the liquid. The diameter of the vortex core will be determined by the rate of rotation of the liquid and the amount of gas or vapor separated from the slurry. For effective gas-liquid separation, the gas core length should be at least equal to the diameter of the withdrawal conduit, and should usually not exceed about 10 times the conduit diameter.

To achieve an effective separation of the gas or vapor from the swirling liquid, the gas withdrawal rate should be controlled so as to provide adequate interface surface area in the vortex core, and provide adequate time for the rotating liquid to disengage from the vapor portion. This gas flow rate control can be accomplished by monitoring the position of the lower end or tip of the vortex core with a suitable density gauging device, such as with a nuclear radiation gauge, and automatically controlling the gas withdrawal rate through a valve controlled by a servo circuit so as to maintain the vortex tip within the desired location range.

It is an advantage of this invention that the deposition of coke on the separator inner wall is minimized or eliminated, due to the continuous washing action of the rotating liquid and the formation of the liquid vortex for effective gas-liquid separation for hot hydrogenated hydrocarbon fluids.

The centrifugal forces existing in the gas-liquid phase separator are also used to separate from the liquid any particulate catalyst which may be carried over from the catalytic reaction zone by the liquid effluent stream. Because the catalyst particles will tend to be thrown to the periphery of the rotating liquid, a clean liquid stream can be withdrawn from the downstream or lower end of the phase separation zone. Such separation permits using in the reaction zone a finer size particulate catalyst having more surface area and activity than would otherwise be possible, since any catalyst particles carried out of the reactor by the effluent liquid would be separated from the liquid products and returned to the reaction zone via a recycled ebullating-liquid flow stream. This arrangement also allows the reactor to be operated nearly full of catalyst without concern about catalyst carryover and loss, and make better use of the reactor volume.

In another embodiment of this invention, the same phase separation concepts for hot hydrocarbon stream utilizing a liquid vortex are applied to the internal liquid recycle loop within an ebullated catalyst bed reactor. The vortex pattern is established for the reactor liquid within the upper end of the liquid downcomer conduit. The effluent gas portion is withdrawn from the top of the reactor, and the liquid portion is withdrawn from the liquid recycle conduit for further processing. To control the size of the vortex core within the liquid downcomer, a sonic device would be installed in the gas effluent conduit to measure the depth of the vortex gas core. Alternatively, the density of the liquid product could be monitored and the gas withdrawal rate adjusted to just eliminate gas entrainment in the liquid.

DESCRIPTION OF PREFERRED EMBODIMENTS

Figure 1:
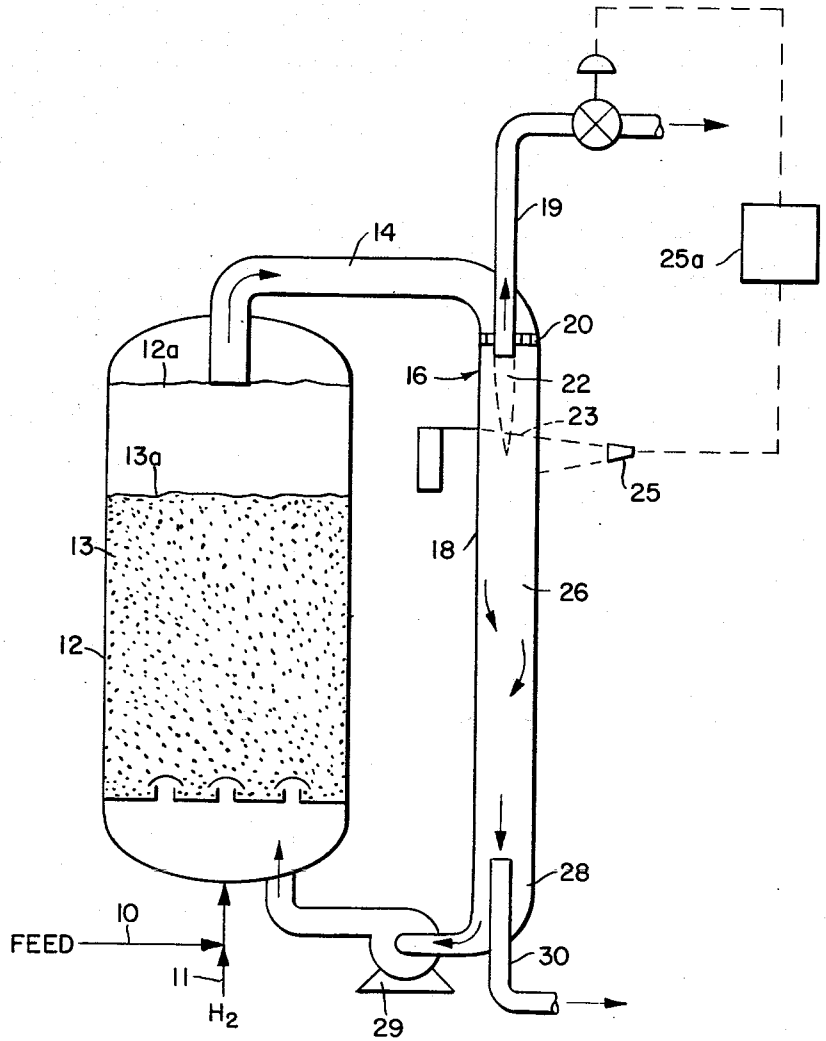
FIG. 1 is a schematic cross-sectional diagram of a phase separator configuration utilizing a liquid vortex, located external to a catalytic reactor.

As shown in FIG. 1, a heavy hydrocarbon feedstream 10, such as a coal-oil slurry, is introduced with hydrogen at 11 into reactor 12, which is preferably an upflow, ebullated-catalyst-bed type reactor operated at elevated temperature and pressure conditions. Catalyst bed 13 is expanded to level 13*a* by upward flow of gas and recycled liquid, as is generally taught by U.S. Pat. No. 3,519,555 to Keith. Useful operating conditions for reactor 12 are within the range of 700°–900° F. temperature, 1500–4000 psig hydrogen partial pressure, and space velocity of 0.4–2.0 $V_f/hr/V_r$ (volume of feed per hour per volume of reactor). An effluent stream 14, containing gaseous and liquid portions at such elevated temperature and pressure conditions, is withdrawn from the reactor 12 at liquid level 12*a* and passed to phase separation unit 16 for separation of the usually minor gaseous portion from the liquid. This separator comprises a generally vertical outer separation conduit 18, an inner inwardly-extended conduit 19, and vortex flow-producing means 20, such as comprising one or more nozzles or vanes oriented so as to impart a helical or vortex flow pattern to the liquid-gasous mixture within conduit 18.

The fluid entering at 14 passes through the nozzles or vanes at 20, which impart a swirling motion to the fluid and produce a vortex flow pattern within conduit 18 with the vortex having a gas core 22. At the core of the vortex, the vapor portion will be separated from the liquid due to centrifugal forces acting on the liquid, and the vapor is withdrawn upwardly through conduit 19. The diameter of the gas withdrawal conduit 19 should not exceed that of the gas vortex 22. Also, the cross-sectional area of conduit 19 should be at least 25%, but not exceed about 50% of the cross-sectional area of outer conduit 18. As the swirling slurry liquid flow pattern proceeds further down conduit 18, the vortex pattern will gradually diminish in size and disappear as the viscous drag forces slow the rotation of the liquid. The diameter of the vortex core 22 will be determined principally by the amount of vapor separated from the liquid and the rotational rate of the liquid. The vortex core vertical depth should be at least equal to the diameter of conduit 19, and preferably between about 2 and 10 times the diameter of conduit 19. The tangential flow velocity of the liquid in conduit 19 should be at least about twice the linear flow velocity in the conduit 18, and preferably three to five times that linear flow velocity.

To obtain effective separation of the gas portion from the swirling liquid within the vortex, the gas withdrawal rate in conduit 19 is controlled at valve 21 so as to provide adequate surface area in the vortex core 22, and sufficient time for the vapor portion to disengage effectively from the rotating liquid. This is accomplished by monitoring the position of the downstream end or tip 23 of vortex core 22, such as by a nuclear gauge 25 having a radiation source, and controlling the gas withdrawal rate through valve 21 so as to maintain vortex core tip 23 within the desired location range.

For the remaining liquid portion at 26 downstream of the vortex core, a major portion is recycled to reactor 12 via recycle pump 29 to help expand the catalyst bed 13. A minor portion of the liquid at 26 is withdrawn through inwardly-extended conduit 30 and passed on to further processing steps as desired.

It is another feature of this invention that the centrifugal forces in the swirling or rotating liquid at 26 within conduit 18 are also used to separate any fine particulate catalyst which may be contained in the liquid. Such catalyst particles may be carried over from the reactor 12 along with the net liquid reactor effluent stream 14, as also shown in FIG. 1. The rotating liquid and catalyst at 28 in conduit 18 is mainly recycled to the reactor 12 via recycle pump 29, while a liquid portion is withdrawn at conduit 30 for further processing. Such liquid-gas phase separation configuration permits using in reactor 12 a finer catalyst particle size having more surface area than would otherwise be possible, as any catalyst particles carried out of the reactor by upflowing liquid at 14 can be separated from the liquid product stream at 30 and returned to the reactor via the ebullating liquid flow stream 28 and pump 29. A net catalyst-free reactor liquid product is withdrawn at conduit 30, which is inserted into the lower end of conduit 18.

For effective withdrawal of clean liquid, the cross-sectional area of inner conduit 30 should not exceed about 50% of the cross-sectional area of outer conduit 18, and should preferably be between about 10–50%, such that the flow is sampled isokinetically. The cross-sectional area of conduit 18 and conduit 30 should be in the ratio of the recycle flow and the liquid withdrawal rate, which is typically between about 2 and 10. Conduit 30 is inserted into conduit 18 to a distance at least equal to the diameter of conduit 18, and preferably by 1.5 to 5 times its diameter. This arrangement also allows the reactor 12 to be operated nearly full of catalyst 13 without much possibility of its carryover into process liquid stream 30, and thus makes more effective use of the reactor volume.

Figure 2:
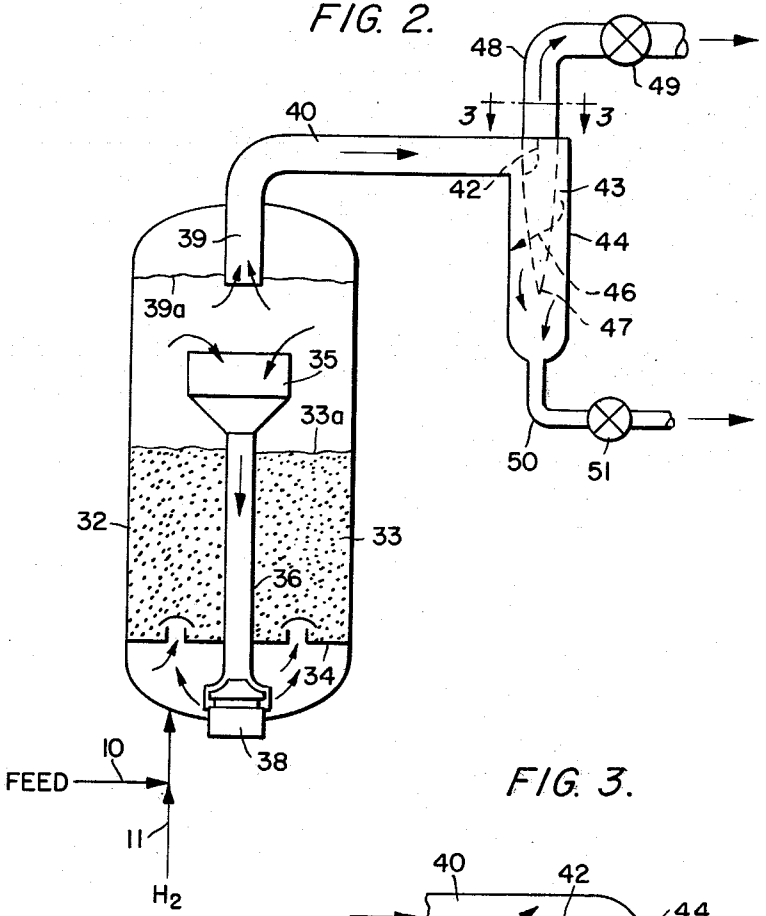
FIGS. 2 and 3 show an alternative phase separator configuration.
Figure 3:
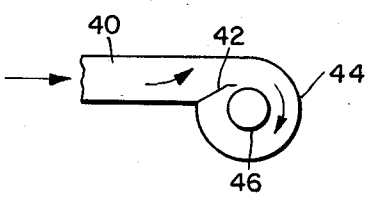

An alternative configuration for this invention utilizing liquid vortex flow for gas-liquid phase separation is shown in FIGS. 2 and 3, wherein at least one tangentially-oriented nozzle is provided for producing the vortex flow configuration. Reactor 32 is similar to reactor 12 in FIG. 1 except an internal liquid recycle arrangement for the reactor is provided. Catalyst bed 33 is expanded to level 33*a* by upflowing liquid and gas passing through distribution 34. The recycled liquid then overflows into receiver 35 and passes through downcomer conduit 36 and recycle pump 38 to flow distribution 34, generally as described in U.S. Pat. No. 3,124,518 to Guzman.

An effluent stream, containing gaseous and liquid portions at elevated temperature and pressure conditions, is withdrawn at 39 from the upper end of reactor 32 at near liquid level 39*a*. The hydrocarbon liquid-gas mixture in conduit 40 passes through one or more nozzles 42 to form a liquid vortex flow configuration 43 within casing 44, said vortex having a gas core 46. An inwardly-extending conduit 48 is provided within casing 44 for withdrawal of the gas portion from core 46, and the swirling liquid portion passes downwardly through casing 44 and is withdrawn at 50. If desired, casing 44 can be internally-coated or lined with a hard-surfaced material, such as a ceramic, to minimize or prevent erosion by the flowing coal slurry liquid.

Similarly as for FIG. 1, the length of gas core 46 is monitored, such as by a nuclear gauge (not shown), and is controlled to within a desired range by controlling the gas withdrawal rate through conduit 48 using valve 49.

Figure 4:
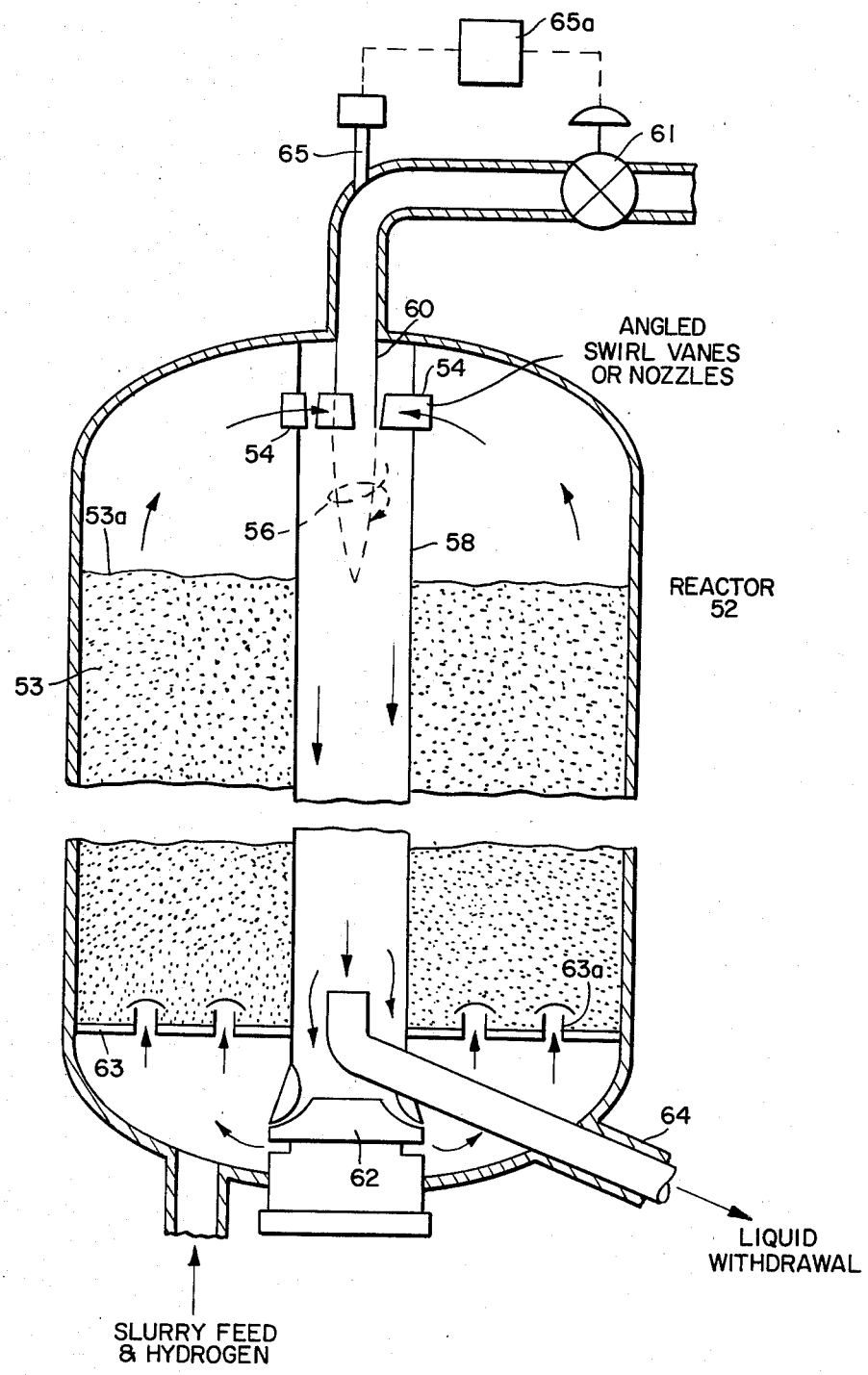
FIG. 4 is a cross-sectional diagram showing a vortex phase separator located within the recycle liquid downcomer of an ebullated catalyst bed type reactor.

Another embodiment of this invention is generally shown by FIG. 4, wherein the same phase separation concepts utilizing a vortex flow pattern are used directly in the internal liquid recycle loop within reactor 52 having an ebullated catalyst bed 53. The catalyst bed 53 is expanded by upflowing liquid and gas to level 53*a*, while the reactor liquid level is maintained sufficiently high to cover the one or more nozzle openings 54 into downcomer conduit 58. Openings 54 are oriented so as to produce a liquid vortex flow configuration having a gas core 56 within the upper portion of conduit 58, similarly as for the FIG. 1 embodiment. The effluent gas portion is withdrawn from core 56 through inwardly-extended conduit 60 from the upper end of reactor 52. The major liquid portion is recycled through expanded catalyst bed 53 via liquid downcomer 58, recycle pump 62, and flow distributor 63. A minor liquid portion is withdrawn from conduit 58 through inwardly-extended conduit 64 for further processing as desired.

Although with this phase separation arrangement control of the size of the vortex core 56 is somewhat difficult due to the relative inaccessibility of the reactor internal parts, it is contemplated that a sonic-type detection device 65 would be provided in the gas withdrawal conduit 60 to measure the depth of the gas core 56. The depth and size of vortex core 56 is monitored by detection device 65 and is controlled by varying the gas withdrawal rate through valve 61. Alternatively, the density of the liquid product stream at 64 can be monitored by suitable devices (not shown), and the gas withdrawal rate at 60 controlled by valve 61 so as to just eliminate any gas entrainment in the liquid product stream 64.

Although this invention has been described in terms of the accompanying drawings and preferred embodiments, it will be appreciated by those skilled in the art that many modifications and adaptations of the basic process can be made, and that specific features can be used in various combinations, all within the spirit and scope of the invention, which is defined solely by the following claims.

I claim:

1. A phase separation process for heavy hydrocarbon liquids containing a gas portion at elevated temperature and pressure conditions, comprising:

(a) introducing the liquid-gas mixture into a separation zone containing at least one flow passageway oriented to produce a swirling vortex flow pattern;

(b) passing the mixture through the flow passageway and forming a vortex flow pattern within the separation zone, with said vortex having an inner gas core portion;

(c) monitoring location of the downstream end of the vortex gas core, and withdrawing a gas stream from within the vortex core at a rate sufficient to maintain said gas core downstream end within a desired location range; and (d) withdrawing the swirling liquid portion downstream from the vortex and passing it to further processing.

2. The process of claim 1, wherein the flow passageway comprises at least one tangentially-oriented nozzle.

3. The process of claim 1, wherein the vortex flow pattern is produced by passing the liquid-gas mixture through multiple swirl vanes.

4. The process of claim 1, wherein the vortex flow pattern is oriented substantially vertically within the phase separation zone, and the gaseous portion is withdrawn from above the liquid vortex at a rate sufficient to maintain the gas core depth at least equal to the core diameter.

5. The process of claim 1, wherein the vortex gas core position is monitored by a nuclear density gauging device, and the rate of gas withdrawal is controlled by an output signal from said gauging device.

6. The process of claim 1, wherein the stream into the phase separation zone is a coal-derived hydrocarbon liquid slurry containing an entrained gaseous portion.

7. The process of claim 6, wherein said hydrocarbon liquid introduced into the separation zone has temperature exceeding about 500° F.

8. The process of claim 1, wherein the swirling liquid from step (d) contains catalyst particles which are retained in the liquid, and including the further step of withdrawing a clean liquid stream from a central portion of the swirling liquid containing catalyst particles, and passing said clean liquid stream to further processing.

* * * * *